US012044150B2

(12) United States Patent
Nasini et al.

(10) Patent No.: US 12,044,150 B2
(45) Date of Patent: Jul. 23, 2024

(54) PLANT BASED UPON COMBINED JOULE-BRAYTON AND RANKINE CYCLES WORKING WITH DIRECTLY COUPLED RECIPROCATING MACHINES

(71) Applicant: NUOVO PIGNONE TECNOLOGIE—SRL, Florence (IT)

(72) Inventors: Ernesto Nasini, Florence (IT); Marco Santini, Florence (IT); Riccardo Bagagli, Florence (IT); Francesco Bellantone, Florence (IT); Francesco Chiesi, Florence (IT)

(73) Assignee: Nuovo Pignone Tecnologie—SRL, Florence (IT)

( * ) Notice: Subject to any disclaimer, the term of this patent is extended or adjusted under 35 U.S.C. 154(b) by 148 days.

(21) Appl. No.: 17/756,166

(22) PCT Filed: Nov. 12, 2020

(86) PCT No.: PCT/EP2020/025513
§ 371 (c)(1),
(2) Date: May 18, 2022

(87) PCT Pub. No.: WO2021/098985
PCT Pub. Date: May 27, 2021

(65) Prior Publication Data

US 2022/0403760 A1 Dec. 22, 2022

(30) Foreign Application Priority Data

Nov. 22, 2019 (IT) ..... 102019000021987

(51) Int. Cl.
*F01K 23/08* (2006.01)
*F01K 19/04* (2006.01)
(Continued)

(52) U.S. Cl.
CPC ..... *F01K 23/08* (2013.01); *F01K 19/04* (2013.01); *F01K 23/065* (2013.01); *F01K 25/103* (2013.01)

(58) Field of Classification Search
CPC ..... F01K 23/08; F01K 23/12; F01K 25/103
See application file for complete search history.

(56) References Cited

U.S. PATENT DOCUMENTS 3,698,182 A * 10/1972 Knoos ..... F02G 1/05 60/525
2016/0003108 A1* 1/2016 Held ..... F01K 25/103 60/517
(Continued)

FOREIGN PATENT DOCUMENTS

CH 276514 A 7/1951
GB 2307277 A 5/1997
(Continued)

OTHER PUBLICATIONS

Machine translation of JP H09-144560 A, accessed Dec. 7, 2023. (Year: 2023).*

*Primary Examiner* — Jonathan R Matthias
(74) *Attorney, Agent, or Firm* — Paul Frank + Collins P.C.

(57) ABSTRACT

The disclosure concerns a waste heat recovery cycle system and related method in which a Brayton cycle system operates in combination with a Rankine cycle system. The Brayton cycle system has a heater configured to circulate a fluid, namely an inert gas, in heat exchange relationship with a heating source, such as an exhaust gas of a different system, in order to recover waste heat from such different system by heating the inert gas. The Rankine cycle system has a heat exchanger configured to circulate a second fluid, in heat exchange relationship with the inert gas of the Brayton cycle system to heat the second fluid while at the
(Continued)

same time cooling the inert gas. The second fluid can be selected among fluids having a boiling point at a temperature lower than the temperature of the inert gas from the expansion unit/group in the Brayton cycle system.

15 Claims, 7 Drawing Sheets

(51) Int. Cl.
*F01K 23/06* (2006.01)
*F01K 25/10* (2006.01)

(56) References Cited

U.S. PATENT DOCUMENTS

2016/0348539 A1* 12/2016 Peter ..... F02C 1/05
2019/0063315 A1* 2/2019 Jung ..... F02C 1/08
2021/0277806 A1* 9/2021 Velloso Mohedano ..... F02C 7/143

FOREIGN PATENT DOCUMENTS

IT 102018000006187 A1 12/2019
JP H09144560 A 6/1997

* cited by examiner

PLANT BASED UPON COMBINED JOULE-BRAYTON AND RANKINE CYCLES WORKING WITH DIRECTLY COUPLED RECIPROCATING MACHINES

TECHNICAL FIELD

The present disclosure concerns an improved thermodynamic plants based upon combined Joule-Brayton and Rankine cycles working with directly coupled reciprocating machines. Embodiments disclosed herein specifically concern improved thermodynamic systems based upon combined Joule-Brayton and Rankine cycles optimized to have reduced dimensions with respect to prior systems and to be easily coupled with external mechanic load appliances.

BACKGROUND ART

Thermodynamic systems, where a working fluid is processed in a closed circuit and undergoes thermodynamic transformations eventually comprising phase transitions between a liquid state and a vapor or gaseous state, are typically used to convert heat into useful work, and in particular into mechanical work and/or into electric energy. Conveniently, these systems can be used to recovery waste heat of exhaust gas of different processes.

According to the Italian patent application N. 102018000006187, a thermodynamic system and a related method are disclosed as waste heat recovery cycle system, wherein the exemplary heat recovery cycle system includes a Brayton cycle system having a heater configured to circulate gaseous carbon dioxide in heat exchange relationship with a heating fluid to heat carbon dioxide. In accordance with an example, an exemplary waste heat recovery system is disclosed being integrated (directly coupled) with heat sources to allow a higher efficiency recovery of waste heat to be converted into mechanical power for electricity generation and/or mechanical application such as the driving of pumps or compressors. The heat sources may include but are not limited to combustion engines, gas turbines, geothermal, solar thermal, flares and/or other industrial and residential heat sources.

The system disclosed in the Italian patent application N. 102018000006187 allows to achieve a high efficiency and cost effective solution (small equipment due to $CO_2$ selection as working fluid) to convert waste heat into mechanical energy, thanks to the possibility to directly couple (with higher temperature difference and consequently higher efficiency) the working fluid with the heat source; a safe & environmental friendly solution ($CO_2$ has not EHS concerns).

Accordingly, an improved system and method for recovering the remaining heat of a thermodynamic system is proposed herein below.

SUMMARY

It has been discovered that the remaining heat of a thermodynamic system, i.e. the heat discharged by the system eventually along with a portion of the heat source not exploited by the system, often is still sufficiently high and may be validly converted into mechanical energy using a Rankine cycle.

Thus, in one aspect, the subject matter disclosed herein is directed to a waste heat recovery cycle system and related method in which a Brayton cycle system operates in combination with a Rankine cycle system. The Brayton cycle system has a heater configured to circulate a fluid, namely an inert gas, such as carbon dioxide, in heat exchange relationship with a heating source, such as an exhaust gas of a different system, in order to recover waste heat from such different system by heating the inert gas to an intermediate temperature between the initial temperature of the inert gas and the initial temperature of the heating fluid. The Rankine cycle system has a heat exchanger configured to circulate a second fluid, in heat exchange relationship with the inert gas of the Brayton cycle system to heat the second fluid while at the same time cooling the inert gas. The second fluid can be selected among fluids having a boiling point at a temperature lower than the temperature of the inert gas from the expansion unit/group in the Brayton cycle system and can be an organic fluid, or a refrigerant fluid, steam, ammonia, propane or other suitable fluids.

Thus, the subject matter disclosed herein is directed to a new waste heat recovery cycle system and to a related method of operating the same, wherein a combined Brayton and Rankine cycle system is obtained by connecting the reciprocating compression unit/group and the reciprocating expansion unit/group of the Brayton cycle system together with the reciprocating expansion unit/group of the Rankine cycle system on the same crank shaft. This configuration allows a higher efficiency recovery of waste heat to be converted into mechanical power for electricity generation and/or mechanical application such as the driving of pumps or compressors.

BRIEF DESCRIPTION OF THE DRAWINGS

A more complete appreciation of the disclosed embodiments of the invention and many of the attended advantages thereof will be readily obtained as the same becomes better understood by reference to the following detailed description when considered in connection with the accompanying drawings, wherein.

DETAILED DESCRIPTION OF EMBODIMENTS

According to one aspect, the present subject matter is directed to a waste heat recovery system based on a combined Brayton and Rankine cycle, wherein the Brayton cycle comprises a heater configured to circulate an inert gas, such as carbon dioxide, in heat exchange relationship with a waste heat source to heat the inert gas, wherein a heat exchanger is configured to evaporate the working fluid of the Rankine cycle system by exchanging heat with the working fluid of the Brayton cycle system and wherein the expansion unit/group of the Rankine cycle system is mechanically coupled with the expansion unit/group and the compression unit/group of the Brayton cycle system. The waste heat source can include combustion engines, gas turbines, geothermal, solar thermal, industrial and residential heat sources, or the like. The expansion unit/group and the compression unit/group of the Brayton cycle system and the expansion unit/group of the Rankine cycle are reciprocating machines connected to a common shaft, the common shaft being directly coupled with an external appliance, such as a generator.

Figure 1:
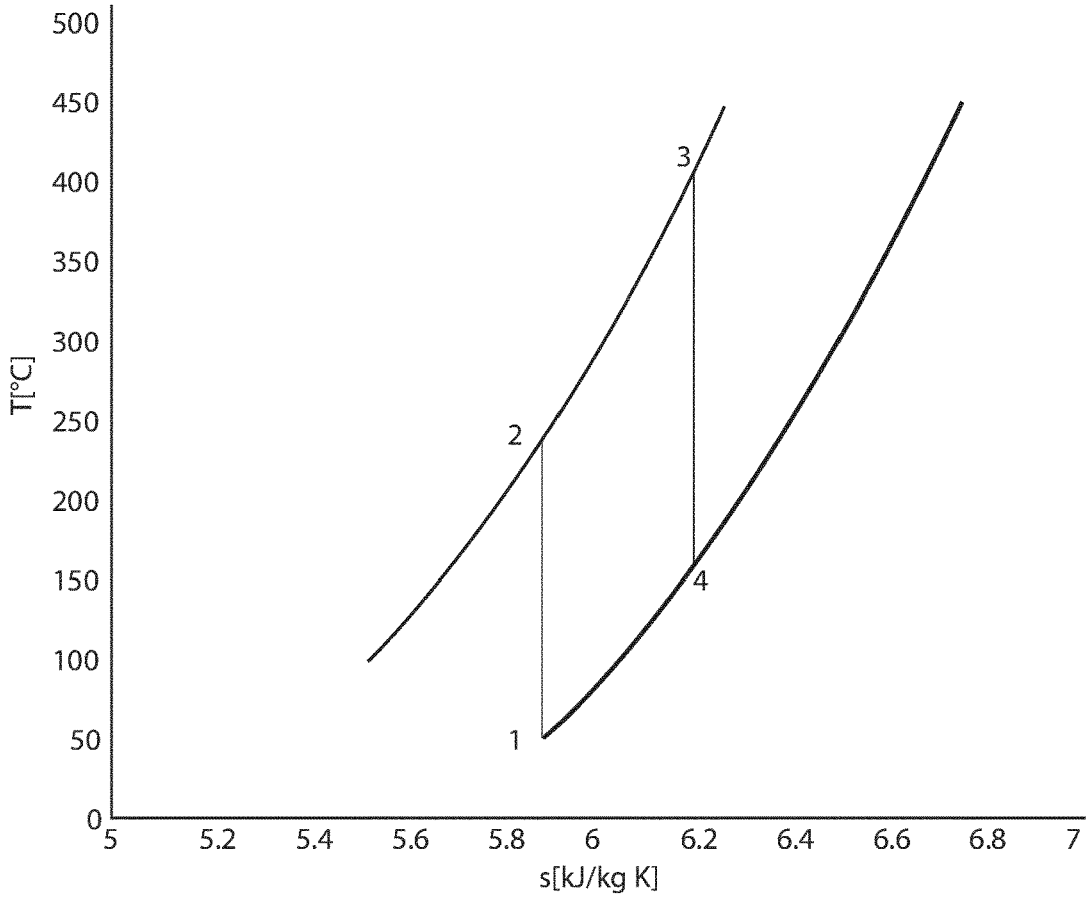
FIG. 1 illustrates a T-S diagram of a known, ideal Brayton cycle.

Referring now to the drawings, a known ideal Brayton cycle comprises two isentropic and two isobaric processes as shown in the T-S diagram depicted in FIG. 1. The isobaric processes relate to heating and cooling of the process fluid, while the isentropic processes relate to the expansion and compression of the process fluid.

Figure 2:
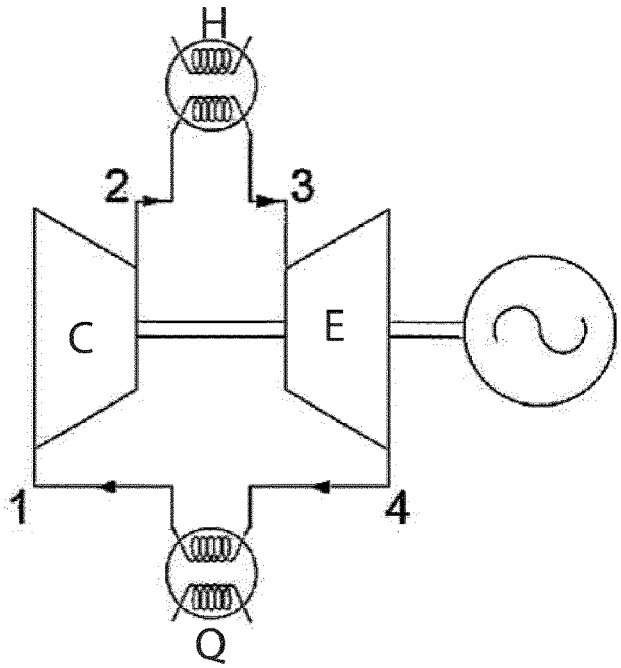
FIG. 2 illustrates a known Brayton engine.

With reference to FIG. 2 showing a known exemplified Brayton engine, the process fluid is isentropically compressed by a compressor C from point 1 to point 2 using compressing power Lc, isobarically heated from point 2 to point 3 by a heater H providing heat Qin, isentropically expanded by an expander E from point 3 to 4 producing expansion power Le, isobarically cooled from point 4 to 1 by a cooler Q exchanging heat Qout.

As compressor and expander are mechanically coupled, the net power the machinery is able to produce is Ln=Le−Lc. The efficiency η is the ratio between net power Ln and heat Qin and can be shown to be:

$$\eta = 1 - \frac{T_1}{T_2} = 1 - \beta^{-\varphi}$$

where $T_1$ and $T_2$ are, respectively, the temperature before and after compression, β is the compression ratio $p_2/p_1=p_3/p_4$, $\varphi=1-1/k$ with k being the ratio between the specific heat of the process fluid at constant pressure $C_p$ and constant volume $C_v$.

The net power Ln can be expressed as a function of β and $T_1$, $T_3$ as follows:

$$L_n = \eta \cdot Q_{in} = (1-\beta^{-\varphi}) \cdot C_p(T_3 - T_2) = (1-\beta^{-\varphi}) \cdot \frac{kRT_1}{k-1}\left(\frac{T_3}{T_1} - \beta^{\varphi}\right)$$

Differentiating, it can be shown that the maximum net power is obtained when $T_2=T_4$.

With this background in mind, and turning now to embodiments of the new waste heat recovery system, it has been realize that carbon dioxide as processing fluid, in the exemplificative ranges of pressures and temperatures, as compared with other inert gases like $N_2$, He, Ne, Ar, Xe, has a very good net power/compression power ratio Ln/Lc (0.716), but poor efficiency η (0.28). For example, Nitrogen has an ideal efficiency of 0.37, but poor Ln/Lc (0.343). Helium has an even greater ideal efficiency (0.47), but very poor Ln/Lc (0.109). It means that, to produce 1 MW of net power, 1.4 MW of compression power is required (in ideal condition) with $CO_2$ against 2.9 MW for Nitrogen and 9.2 MW for Helium. Reference throughout the specification to "inert gas" means that the particular gas described in connection with an embodiment is inert under the operation conditions of the disclosed system.

Under real conditions, compression work increases and expansion work decrease thus, for low values of Ln/Lc, the net power could become a very low percentage of compression work, or even negative. Hence the choice of carbon dioxide as a preferred processing fluid in embodiments herein, preferably using arrangements capable of increasing efficiency.

The usage of carbon dioxide as the working fluid has furthermore the advantage of being cheap, non-flammable, non-corrosive, non-toxic, and able to withstand high cycle temperatures (for example above 400° C.). Carbon dioxide may also be heated super critically to high temperatures without risk of chemical decomposition.

As efficiency is the ratio between net power and heat exchanged by the processing fluid with the hot source, in one arrangement, efficiency is increased by reducing such heat by pre-heating the carbon dioxide delivered by the compressor before reaching the heater. This can be advantageously achieved by using part of the heat present in the fluid exiting the expander, i.e. by using a so-called Regenerator as it will be explained below.

In another arrangement, the efficiency is increased by reducing the compression power using inter-stage cooling.

Figure 3:
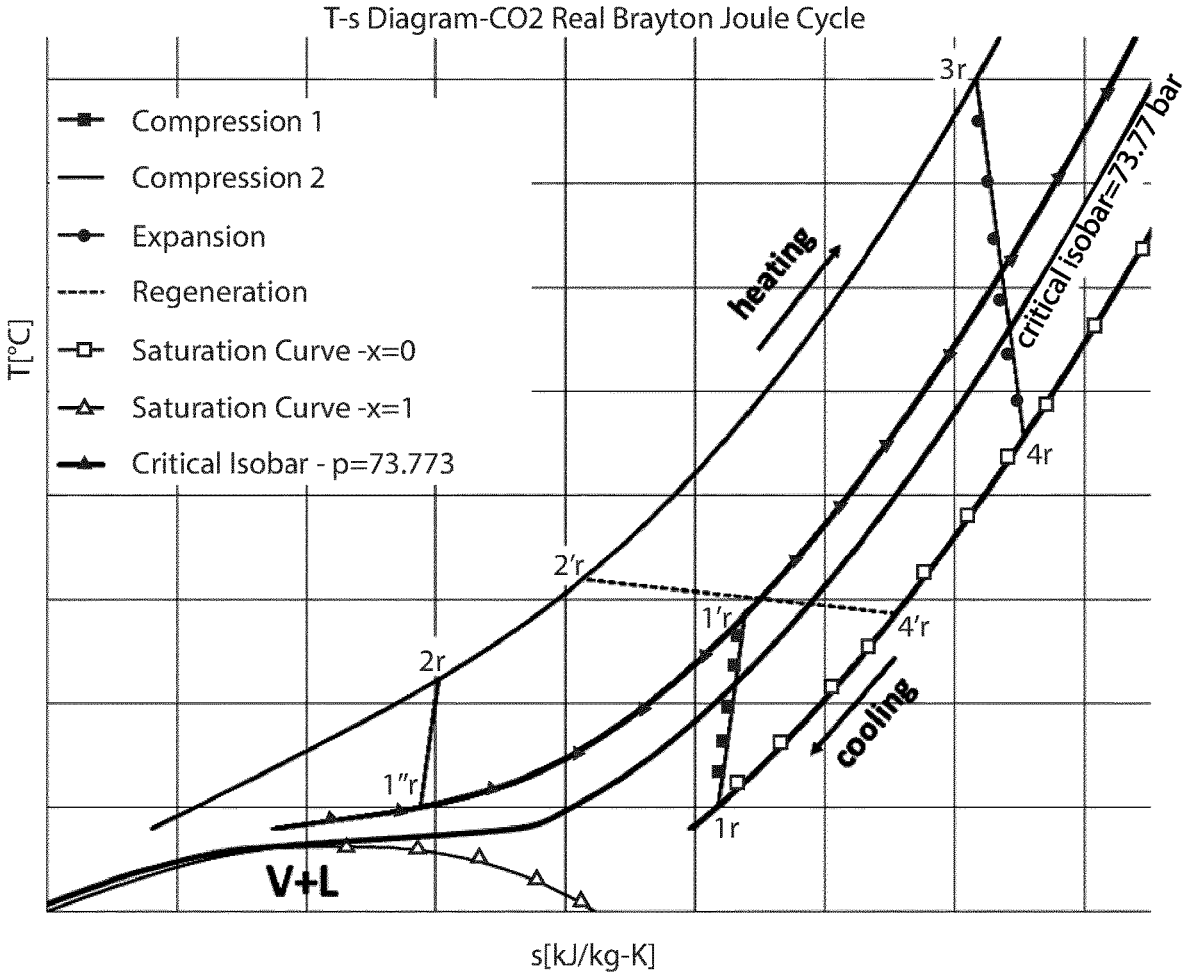
FIG. 3 illustrates a T-S diagram of a known modified real Brayton cycle using $CO_2$ as working fluid.

The effect of the combination of the two arrangements, that can obviously exist independently one from the other, is shown in the T-S diagram of FIG. 3.

Regeneration is reflected by two parts of curves almost coincident with lower and upper isobars, respectively from point 4*r* to 4'*r* as regard of hot side of regenerator heat exchanger, and from 2*r* to 2'*r* as regard of cold side of regenerator heat exchanger, with second points at a lower pressure level than first to account for exchanger pressure drops, while inter-stage compressor cooling is represented by a curve from point 1'*r* to 1"*r*, straddle to mid isobar from point 1'*r* to 1"*r*. Here a real cycle is depicted where the isentropic curves of FIG. 1 are replaced with oblique (polytropic) curves to take into account that, in real expansion and compression, some entropy is always generated by irreversibilities of the processes.

Figure 4:
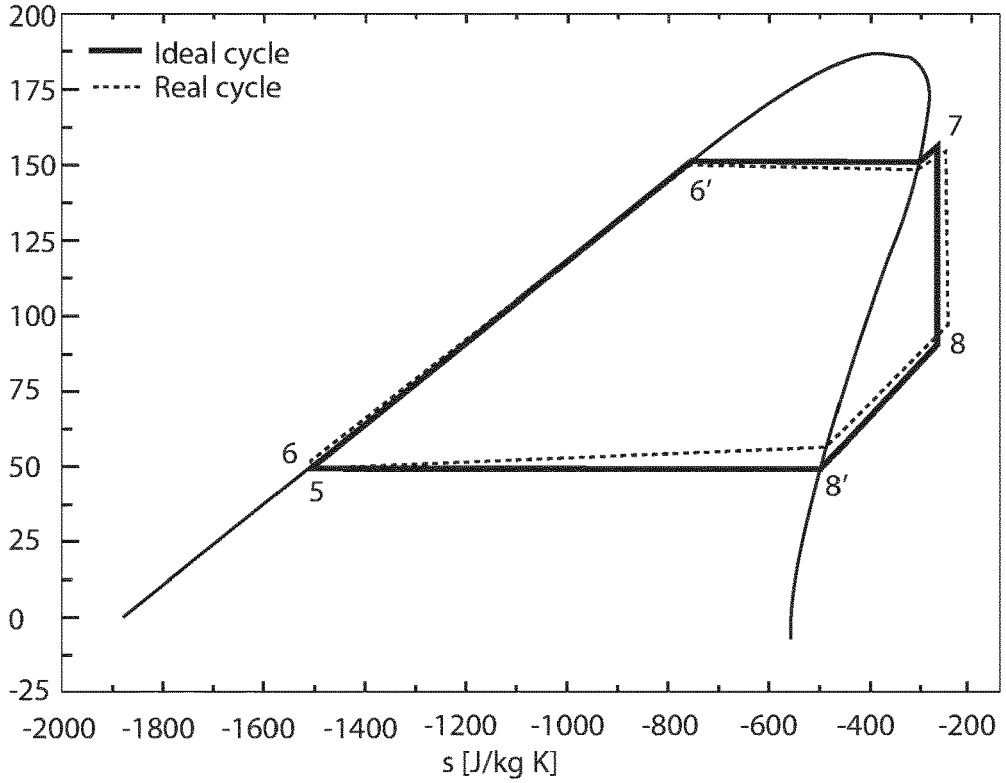
FIG. 4 illustrates a T-S diagram of a known ideal and of a real Rankine cycle using isopentane as working fluid.

Referring to FIG. 4, an ideal Rankine cycle comprises two isentropic and two isobaric processes as shown in the depicted T-S diagram. The isobaric processes relate to heating (comprising evaporation) and cooling (comprising condensation) of the process fluid, while the isentropic processes relate to the expansion and compression of the process fluid.

Figure 5:
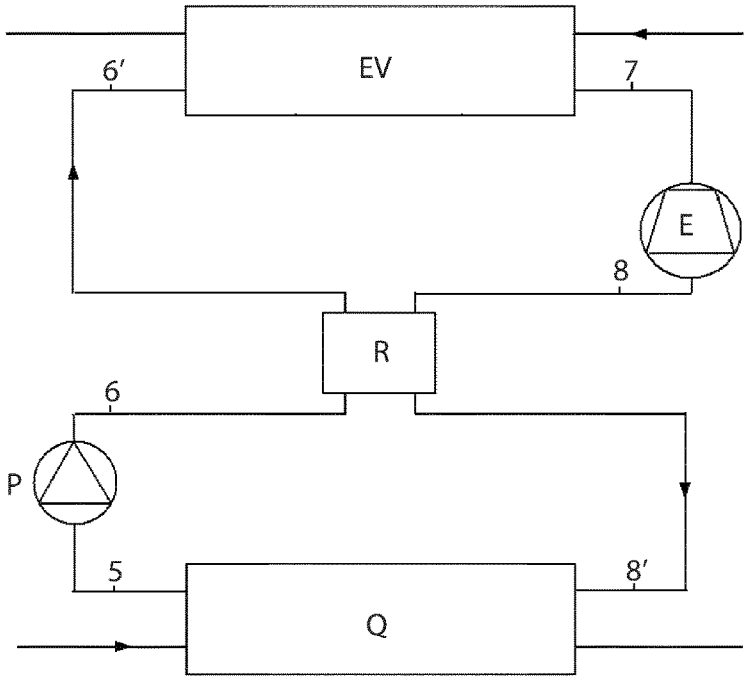
FIG. 5 illustrates a known Rankine engine with regenerator.

With reference to FIG. 5 showing an exemplified Rankine engine, the process fluid is isentropically compressed by a pump P from point 5 to point 6 using compressing power Lc, isobarically heated from point 6 to point 6' by a first heater ("Regenerator", R) and further isobarically heated, evaporated and overheated from point 6' to point 7 by a second heater ("Evaporator", Ev) providing heat Qin, isentropically expanded by an expander E from point 7 to 8 producing expansion power Le, isobarically cooled from point 8 to 8' in the hot side of "Regenerator" R and further cooled, condensed and super cooled from point 8' to 5 by a second cooler "Condenser" Q where the heat Qout is exchanged.

In any real cycle, the presence of irreversibilities lowers the cycle efficiency. Those irreversibilities mainly occur:

during the expansion: only a part of the energy recoverable from the pressure difference is transformed into useful work; the other part is converted into heat and is lost; the isentropic efficiency of the expander is defined by comparison with an isentropic expansion;

in the heat exchangers: the working fluid takes a long and sinuous path which ensures good heat exchange but causes pressure drops that lower the amount of power recoverable from the cycle; likewise, the temperature difference between the heat source/sink and the working fluid generates exergy destruction and reduces the cycle performance.

Still referring to FIG. 4, a real cycle is also depicted where the isentropic curves are replaced with oblique (polytropic) curves to take into account that, in real expansion and compression, some entropy heat is always generated.

DETAILED DESCRIPTION OF NEW EMBODIMENTS

Figure 6:
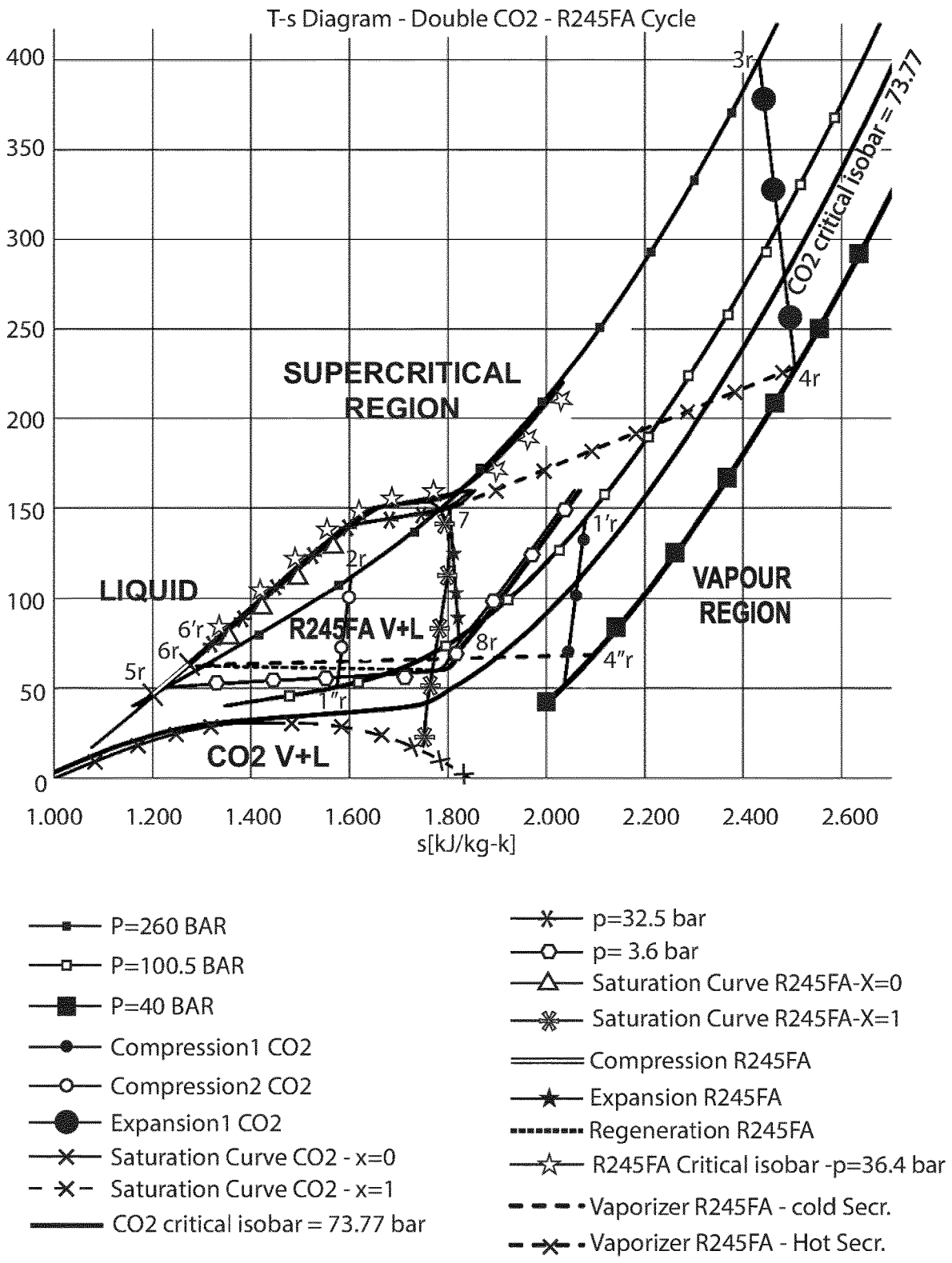
FIG. 6 illustrates a T-S diagram of a new, improved Real Brayton cycle in which a first equipment group is configured to use carbon dioxide as working fluid, that is combined with a Real Rankine cycle, in which a second equipment unit/group is configured to use 1,1,1,3,3-Pentafluoropropane (R245FA) as working fluid.

Referring now to FIG. 6, a T-S diagram of a real Brayton cycle using carbon dioxide as working fluid combined with a real Rankine cycle using 1,1,1,3,3-Pentafluoropropane (R245FA) as a working fluid, according to an exemplary embodiment of the present invention is shown. The organic fluid used as working fluid in the Rankine cycle can be any organic fluid compatible with the operating conditions and with the ecologic concerns, but also steam, ammonia, propane or any other suitable fluid. For example, 2,3,3,3-tetrafluoropropene (or R1234yf) (having a lower GWP and ODP with respect to R245FA) can be used as an alternative to 1,1,1,3,3-Pentafluoropropane (R245FA).

Regeneration of R245FA is reflected by two parts of curves almost coincident with lower and upper isobars, respectively from point 8*r* to 8'*r* as regard of hot side of regenerator heat exchanger, and from 6*r* to 6'*r* as regard of cold side of regenerator heat exchanger, with second points at a lower pressure level than first to account for exchanger pressure drops, while evaporation of R245FA with cooling of $CO_2$ is reflected on the horizontal dotted line from point 4"*r* to point 6'*r*. Additionally, FIG. 6 shows compression of R245FA by a pump from point 5 to point 6, heating by the regenerator from point 6 to point 6' and further heating, evaporation and overheating by the evaporator from point 6' to point 7, expansion from point 7 to 8, cooling from point 8 to 8' in the hot side of "Regenerator" and further cooling, condensation and super cooling from point 8' to 5 by a second cooler "Condenser" where the Qout is exchanged.

Figure 7:
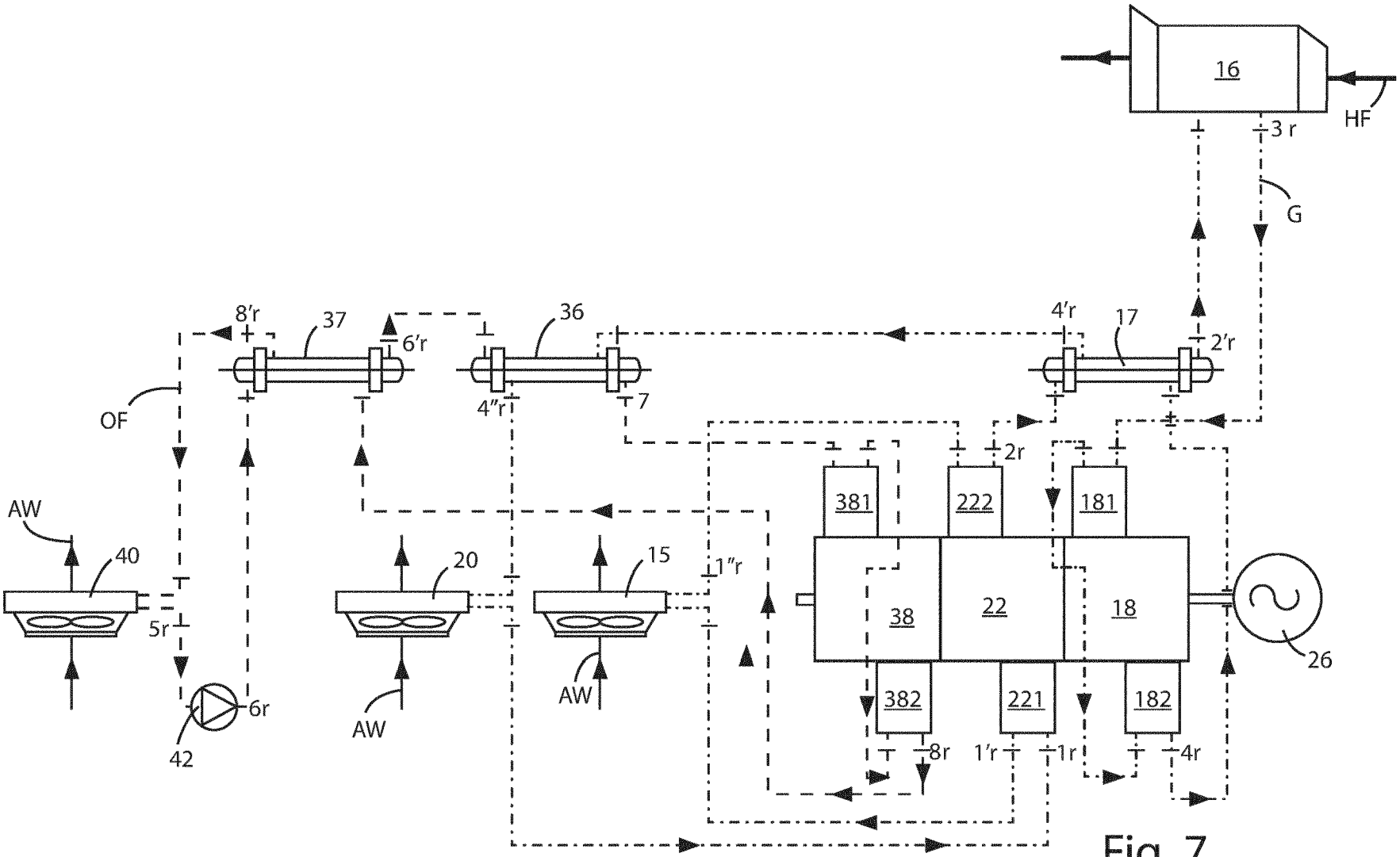
FIG. 7 illustrates a first schematic of a new, improved system for recovering waste heat by combining a Brayton cycle using carbon dioxide as working fluid with a Rankine cycle using 1,1,1,3,3-Pentafluoropropane (R245FA) as working fluid.

Coming to FIG. 7, a new waste heat recovery system is illustrated in accordance with an exemplary embodiment of the invention. The system is configured as an implementation of a waste heat recovery system including a Brayton cycle system, with several key and distinct differences. One difference is that reciprocating volumetric machines are used. Another difference is that a Rankine cycle system is added. The Rankine cycle system has a heat exchanger configured to circulate a working fluid in a heat exchange relationship with the inert gas of the Brayton cycle system. Yet another difference is that a reciprocating expansion unit/group of the Rankine cycle system is mechanically coupled with the reciprocating volumetric machines of the Brayton cycle system along a single, common shaft.

Referring to FIG. 7, a heater 16 is coupled to a heat source, for example an exhaust unit of a heat generation system (for example, an engine). In operation, the heater 16 receives heat from a heating fluid HF e.g. an exhaust gas generated from the heat source, which warms an inert gas G passing through a tube bundle coupled with the heater. In a first exemplary embodiment, the inert gas G exiting from the heater 16 may be carbon dioxide at a first temperature of about 400° C. and at a first pressure of about 260 bar. According to a second exemplary embodiment, pressure can be 105 bar, temperature can vary in the range 360÷420° C. Leaving the heater 16, the hot carbon dioxide G flows to and thorough a reciprocating expansion unit/group 18 to expand the carbon dioxide G. As the pressurized, hot carbon dioxide G expands, it turns a shaft that is configured to drive a first generator 26, which generates electric power. With expanding, carbon dioxide G also cools and depressurizes as it expands. Accordingly, in the aforesaid first exemplary embodiment, the carbon dioxide G may exit the reciprocating expansion unit/group 18 at a second, lower temperature of about 230° C. and a second, lower pressure of about 40 bar; while in the aforesaid second exemplary embodiment, with an upper pressure of 105 bar, this lower pressure can be 30 bar with a temperature of 200° C.

As far as the structure of the reciprocating expansion unit/group 18 is concerned, in one embodiment, the reciprocating expansion unit/group 18 has a plurality of serially arranged reciprocating expansion unit/group stages. By way of illustration and not limitation, an embodiment shown in FIG. 7 comprises two serially arranged reciprocating expansion unit/group stages labeled 181, 182, in which reciprocating expansion unit/group 181, 182, has one reciprocating expansion unit/group each.

The cooled, depressurized carbon dioxide G, still at the second temperature and pressure, flows from the single reciprocating expansion unit/group 18 or last reciprocating expansion unit/group 182 through a heat exchanger 36 (described below) into and through a low pressure, LP, cooler 20. The LP cooler 20 is configured to further cool the carbon dioxide G down to a third temperature (lower than the first temperature or second temperature, alone or combined) of about 40-50° C. (this value being function of environmental condition and cooling medium availability/selection (air/water, AW)). The carbon dioxide G exits the LP cooler 20 and flows into and through a reciprocating compression unit/group 22, which operates to compress and heat the carbon dioxide G to a substantially higher fourth temperature and to a fourth pressure. In passing, the fourth pressure may be about the same or just above the first pressure described above to account for piping and heater 16 pressure drops. Thus, by way of example only, in the aforesaid first embodiment, the now twice heated carbon dioxide G that exits from the reciprocating compression unit/group 22 is at a fourth temperature of about 110° C. and a fourth pressure of about 260 bar, while in the aforesaid second embodiment these temperature and pressure values are respectively of about 108° C. and 105 bar. These values are by way of example only and shall not be considered as limiting the scope of the subject matter disclosed herein.

The reciprocating compression unit/group 22 will now be further described. In one embodiment, the reciprocating compression unit/group 22 may be a multi-stage reciprocating compression unit/group with an intercooler disposed between each stage of the multi-stage reciprocating compression unit/group. The system may comprise a plurality of serially arranged reciprocating compression unit/group stages, each reciprocating compression unit/group stage comprising, one or more reciprocating compression unit/group. In some embodiments, each reciprocating compression unit/group stage can include a single reciprocating compression unit/group. The embodiment shown in FIG. 7 comprises two serially arranged reciprocating compression unit/group stages labeled 221, 222, each comprising one reciprocating compression unit/group.

In the diagrammatic representation of FIG. 7, the two reciprocating compression unit/group stages 221, 222 are paired. Each pair of oppositely arranged reciprocating compression unit/group stages is driven by a common shaft. The same shaft is also connected to the reciprocating expansion unit/group 18.

Coming back to the operating cycle of the system, the carbon dioxide enters the first reciprocating compression unit/group stage 221 at 1*r* (at the third pressure and third temperature explained above) and exits the first reciprocating compression unit/group stage 221 at 1'*r*. A flow path 13 may extend from the exit side of reciprocating compression unit/group stage 221 to the entry side of reciprocating compression unit/group stage 222. Along the flow path 13 an inter-stage heat exchanger or cooler 15 is provided. The inter-stage cooler will be indicated here below as inter-stage heat exchanger 15. Consequently, the (now) compressed carbon dioxide G flowing through the fluid path 13 also flows across the inter-stage heat exchanger 15 and is cooled by a cooling fluid AW, for example air, which flows in the inter-stage heat exchanger 15 that could be, in an example, an air refrigerant heat exchanger. The inter-stage heat exchanger 15 may not exist if compression is realized in a single stage.

The cooled carbon dioxide G now enters the second reciprocating compression unit/group 222 and finally exits the reciprocating compression unit/group stage 222 at 2*r*.

In an embodiment, referring to FIG. 7, the system comprises a heat exchanger 17, also called a regenerator, which is configured to circulate whole or a portion of the cooled, expanded, lower pressure carbon dioxide G from the expander 18 to the LP cooler 20 so that a heat exchange relationship occurs with respect to the carbon dioxide G exiting from the reciprocating compression unit/group 22 and flowing to the heater 16 to allow a pre-heating of the carbon dioxide G up to 160° C. or above before being re-fed to the heater and starting a new cycle.

It has to be noted that the cooled, depressurized carbon dioxide G, as it flows from the single reciprocating expansion unit/group 18 or last reciprocating expansion unit/group 182 still is, according to the aforesaid first exemplary embodiment at the second temperature of about 230° C. and pressure of about 40 bar (or according to the aforesaid second exemplary embodiment, with an upper pressure of 105 bar, at a temperature of 200° C. and pressure of 30 bar) and has to be cooled down to about 40-50° C. (this value being function of environmental condition and cooling medium availability/selection (air/water, AW)). In order to achieve this result a low pressure, LP, cooler 20 is used. The use of the cooler 20 involves a loss in efficiency of the system, due to the need for mechanical energy to operate the cooler 20 itself (pressure drops and fans absorption if air cooler heat exchanger is selected) and due to the need, for all cycles, to release thermal energy to environment, so that the highest heat release temperature, the lowest thermodynamic cycle efficiency. The aforesaid Rankine cycle system combined with the Brayton cycle system has the function to allow a higher recovery of waste heat to be converted into mechanical power for electricity generation and/or mechanical application such as the driving of pumps or compressors.

In particular, still referring to FIG. 7, an evaporator 36 receives heat from the inert gas G (which, as discussed above may be carbon dioxide) circulating from the regenerator 17 to the cooler 20 of the Brayton cycle, heating up, evaporating and superheating a working fluid OF, namely an organic fluid such as 1,1,1,3,3-Pentafluoropropane (R245FA), passing through the evaporator 36. The regenerator 17, the cooler 20 and the evaporator 36 of the Brayton cycle may not all be present at the same time.

In one specific embodiment, the organic fluid vapor OF exiting from the evaporator 36 may be at a first temperature of about 150° C. and at a first pressure of about 32.5 bar. Leaving the evaporator 36, the hot organic fluid vapor OF flows to and thorough the reciprocating expansion unit/group 38 to expand itself. As the pressurized, hot organic fluid vapor OF expands, it turns a shaft that is configured to couple with the same shaft of the reciprocating expansion unit/group 18 and the reciprocating compression unit/group 22 of the Brayton cycle. In particular, in accordance with an embodiment of the invention, the reciprocating expansion unit/group 38 turns the same shaft of the reciprocating expansion unit/group 18 and the reciprocating compression unit/group 22 of the Brayton cycle, i.e. is directly coupled to the same generator 26. While expanding, the organic fluid vapor OF also cools and depressurizes. Accordingly, in a first specific embodiment, the organic fluid vapor OF may exit the reciprocating expansion unit/group 38 at a second, lower temperature of about 71° C. and a second, lower pressure of about 3.6 bar, while in a second specific embodiment the lower temperature is about 71° C. and the lower pressure is about 3.1 bar, being pressure and temperature function of condensation condition and, then, of the environmental temperature.

As far as the structure of the reciprocating expansion unit/group 38 is concerned, in one embodiment, the reciprocating expansion unit/group 38 has a plurality of serially arranged expansion unit/group stages. Each expansion unit/group stage may have, or be formed of, one or more reciprocating expansion units/groups. In other embodiments, each expansion unit/group stage can include a single reciprocating expansion unit/group. By way of illustration and not limitation, an embodiment shown in FIG. 7 comprises two serially arranged expansion unit/group stages labeled 381, 382, in which expansion unit/group stages 381, 382, has one expansion unit/group each.

The cooled, depressurized organic fluid OF, still at the second temperature and pressure, flows from the single expansion unit/group 38 or last expansion unit/group 382 into and through the hot side of regenerator 37 and then into a condenser 40. The condenser 40 is configured to further cool and condensate the organic fluid OF down to a third temperature (lower than the first temperature or second temperature, alone or combined) of about 40-50° C. (this value being function of environmental condition and cooling medium availability/selection (air/water, AW)). The condensate organic fluid exits the condenser 40 and flows into and through a pump 42, which pressurize the organic fluid OF and drive it to the evaporator 36.

In an embodiment, the Rankine cycle comprises a heat exchanger 37, also called a regenerator, which is configured to circulate whole or a portion of the cooled, expanded, lower pressure organic fluid vapor OF from the expansion unit/group 38 to the condenser 40 so that a heat exchange relationship occurs with respect to the organic fluid OF exiting from the pump 42 and flowing to the evaporator 36 to allow a pre-heating of the organic fluid OF up to 62° C. according to the aforesaid first exemplary embodiment wherein condensation happens at about 50° C. and about 3.6 bar, up to 52° C. according to the aforesaid second exemplary embodiment wherein condensation happens at about 40° C. and 3.1 bar, before being re-fed to the evaporator 36 and starting a new cycle.

Figure 8:
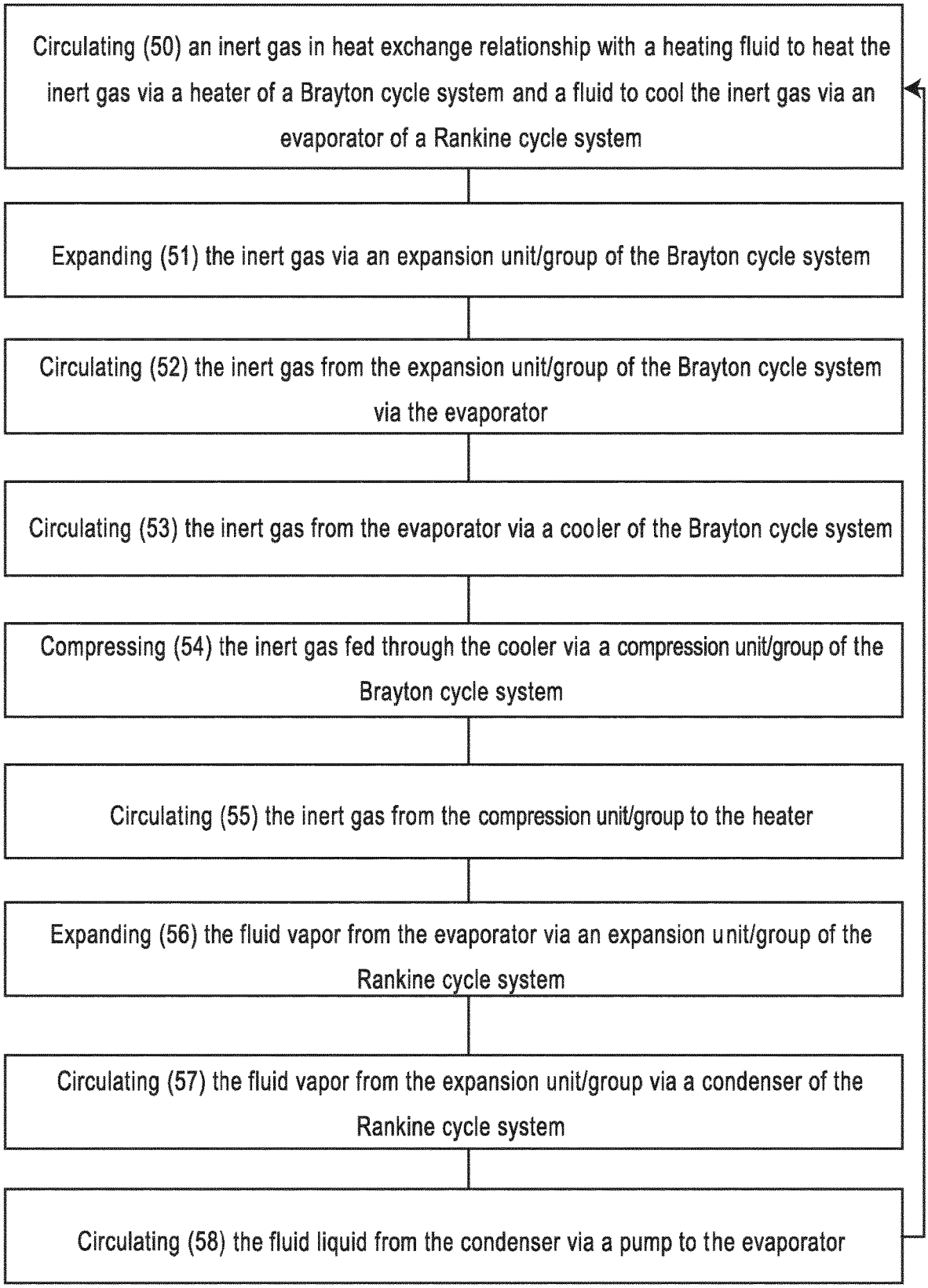
FIG. 8 illustrates a flowchart of the operating process of the system of FIG. 7.

FIG. 8 illustrates a flowchart of the operating cycle of the system of FIG. 7, comprising the following steps:

circulating 50 an inert gas in heat exchange relationship with a heating fluid to heat the inert gas via a heater of a Brayton cycle system and a fluid to cool the inert gas via an evaporator of a Rankine cycle system; the Brayton cycle system comprising an expansion unit/group coupled to the heater and a compression unit/group and the Rankine cycle system comprising an expansion unit/group; the compression unit/group and the expansion unit/group of the Brayton cycle system and the expansion unit/group of the Rankine cycle system being mechanically coupled reciprocating machines;

expanding 51 the inert gas via the expansion unit/group of the Brayton cycle system;

circulating 52 the inert gas from the expansion unit/group of the Brayton cycle system via the evaporator;

circulating 53 the inert gas from the evaporator via a cooler of the Brayton cycle system;

compressing 54 the inert gas fed through the cooler via the compression unit/group;

circulating 55 the inert gas from the compression unit/group to the heater;

expanding 56 the fluid vapor from the evaporator via an expansion unit/group of the Rankine cycle system;

circulating 57 the fluid vapor from the expansion unit/group via a condenser of the Rankine cycle system; and circulating 58 the fluid liquid from the condenser via a pump to the evaporator.

In an exemplary embodiment of the system, referring again to FIG. 7, the two expansion unit/group stages 381, 382 are paired. Each pair of oppositely arranged expansion unit/group stages is driven by a common shaft. In an embodiment, a gearbox connects the various shafts to the compression unit/group 22 and to the expansion unit/group 18 of the Brayton cycle.

The reciprocating volumetric expansion unit/group of the Rankine cycle, the reciprocating volumetric expansion unit/group and the reciprocating volumetric compression unit/group of the Brayton cycle using carbon dioxide as working fluid could be mechanically connected in any known way, for example also including magnetic couplings.

In an embodiment of the system, the expansion unit/group 38 of the Rankine cycle is a reciprocating expansion unit/group, the compression unit/group 22 and to the expansion unit/group 18 of the Brayton cycle also being a reciprocating compression unit/group and a reciprocating expansion unit/group and all of these reciprocating machines are coupled to a common shaft. This configuration is important because of the very different density of the working fluids ($CO_2$ and organic fluid) in the exemplary operating pressure and temperature ranges, and the consequence that the machines should work with very different volumetric flow rates of working fluids, and consequently, in case reciprocating machines are not used, with very different rotational speeds. In fact, the ratio between the volumetric flow rate of $CO_2$ and R245FA is 1.6 at the inlet and 0.55 at the outlet, with a pressure ratio of 6.5 and ranging from 8.5 and 10.5 respectively. This would drive away a person skilled in the art from coupling the different machines on the same shaft. Eventually, the use of a gear unit would have to be considered, this solution being undesirable because it introduces mechanical complexity to the system. Differently, by using reciprocating machines it is possible to operate with different volumetric flow rates of the working fluids by varying the bore, hence the displacement of the machines, and varying the pocket clearances, without any need to use a gear unit.

An additional advantage of the exemplary embodiment of the system according to which the reciprocating expansion unit/group 38 of the Rankine cycle, the reciprocating compression unit/group 22 and the reciprocating expansion unit/group 18 of the Brayton cycle being all coupled to a common shaft is that the use of a gear unit is not needed to couple the common shaft with the generator 26. In fact, the use of reciprocating machines makes it possible to match the network frequencies (50 or 60 Hz) by simply acting on the number of polar pairs.

Additionally, using reciprocating machines allows operating the common shaft at rotation speeds of about 1000 round/minute, with the advantage that direct coupling with most appliances, including a generator 26, and more advantageously a variable frequency drive generator, or process auxiliaries is possible. The coupling with a variable frequency drive (VFD) generator is preferred because of the greater rangeability of this kind of appliance, allowing to better matching possible thermal variations of the source. In addition, a VFD generator can also be used as a starting engine of the system and/or helper in a mechanical drive configuration.

Embodiments herein also relate to a system for recovering waste heat by a combination of a Brayton cycle using carbon dioxide as working fluid combined with a Rankine cycle using 1,1,1,3,3-Pentafluoropropane (R245FA) as working fluid wherein the $CO_2$ Brayton engine comprises inter-stage.

In compression unit/group cylinders, as the piston runs, pressure increases during the compression stroke, i.e. when both suction and discharge valves are closed, whichever type of valves are used.

In Double acting compression unit/group cylinder, as the piston runs, pressure rises at one end (e.g. Head End) and decreases at the opposite end. The pressure reverses at the opposite stroke, according to the formula: $P \cdot V^n$=const. Temperature increases with pressure according to the formula $$T \cdot P\left[\frac{1-n}{n}\right] = const.$$

Thus, limiting the temperature rise in the cylinder, and therefore limiting the corresponding increase of the specific volume and the volumetric flow rate, will reduce the compression work (proportional to the integral of VdP), increasing the overall efficiency of the cycle.

To accomplish limiting the temperature rise in the cylinder and the corresponding increase in specific volume, a spray of liquid (e.g. a mixture of water) can be injected directly in the active effect side of the cylinder in order to reduce the compression work.

In an exemplary embodiment of the system, a spray of liquid (e.g. a mixture of water) can be injected indirectly in the active effect side of the cylinder in order to reduce the compression work, immediately upstream of the cylinder.

The pressure of the liquid shall be higher than actual gas pressure, in order to win resistance and help nebulization, whereas the temperature of the liquid to be sprayed shall be the lowest allowed by environmental conditions. The injected liquid flow rate is such that its partial pressure, once vaporized, is always below its vapor pressure corresponding to the expected gas temperature (i.e. gas temperature after the cooling), to prevent any trace of liquid droplets that could be dangerous for the cylinder components (e.g. the compression unit/group valves). The injected liquid, after exiting from the compression cylinders, is incorporated in the mixture until it is cooled and condensed in the interstage and final cooler. Then the injected liquid is compressed by a pump and re-injected, thus working in a closed loop.

The power consumption of liquid pump is negligible compared to the overall power increase of the system.

Since liquid vapor molar fraction in the mixture with $CO_2$ increases with mixture temperatures and decreases with mixture pressure, liquid spray injection is more effective at lower pressures and higher temperatures. Therefore, as compression stages increase, applying liquid spray injection should be carefully evaluated.

In the T-s Diagram of the system, the liquid injection during compression stages is an iso-enthalpic process that does not change the ideal adiabatic compression work, but the real compression work decreases thanks to the reduced volumetric flow-rate and the increased polytropic efficiency; the whole cycle area increases, as well as the overall efficiency. The thermal duty of the inter-stage cooler is unchanged, and the lower EMTD due to the lower mixture temperature at the exchanger inlet is compensated by the increased overall heat transfer coefficient, due to the condensing $H_2O$ in the mixture.

Even if water injection is more efficient at lower $CO_2$ pressures, it could be applied at all compression stages.

Figure 9:
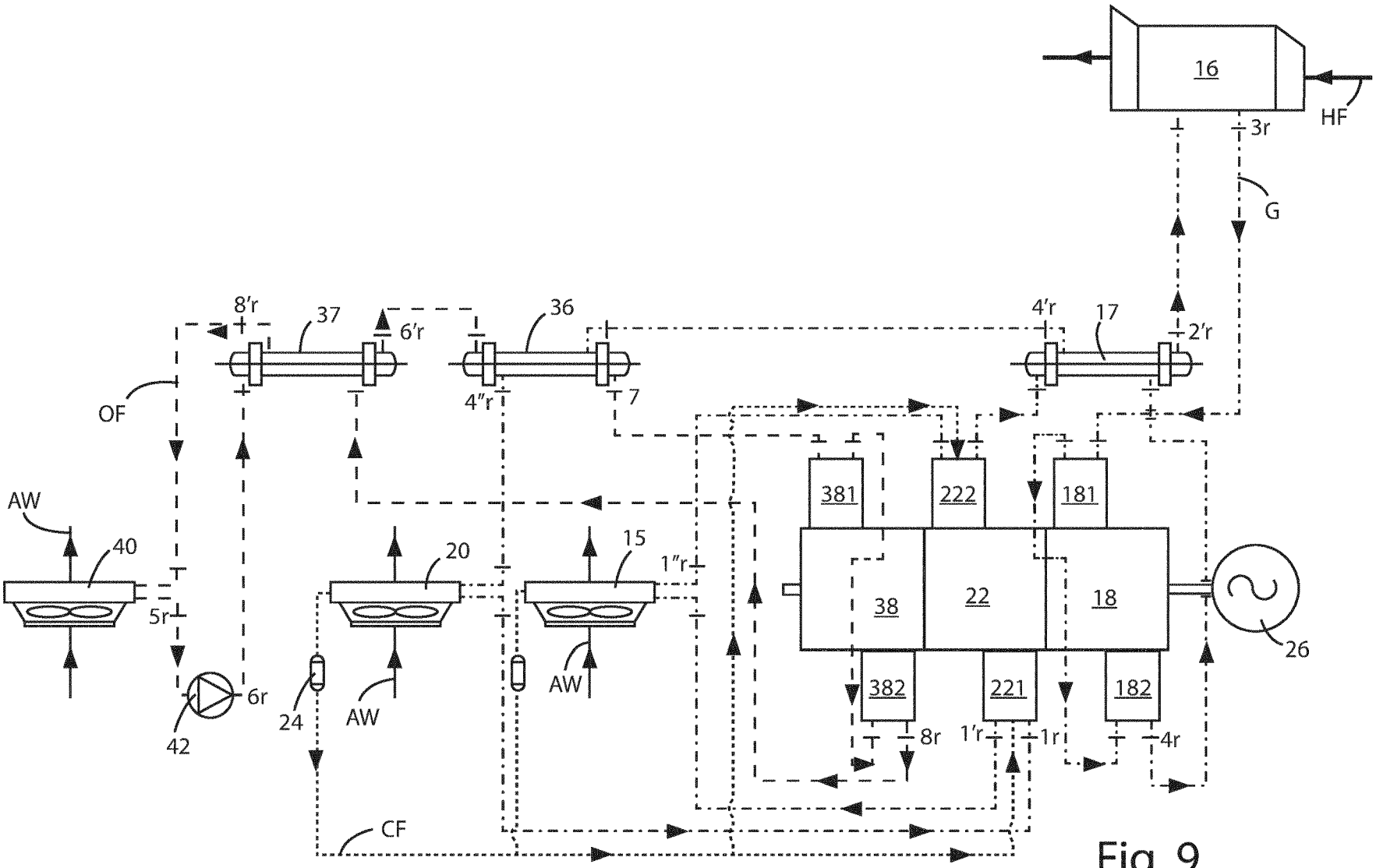
FIG. 9 illustrates a second schematic of a new, improved system for recovering waste heat by a combining a Brayton cycle in which a first equipment group is configured to use carbon dioxide as working fluid with a Rankine cycle, in which a second equipment group is configured to use 1,1,1,3,3-Pentafluoropropane (R245FA) as working fluid.

FIG. 9 illustrates a schematic of a further embodiment of the new system for recovering waste heat by combining a Brayton cycle using carbon dioxide as working fluid with a Rankine cycle using 1,1,1,3,3-Pentafluoropropane (R245FA) as working fluid. The system includes inter-stage cooling through liquid (e.g. water or mixtures thereof) injection inside or upstream the compression cylinders as illustrated on FIG. 9. According to this embodiment, integrated separator drums 23, 24 are placed downstream the inter-stage heat exchangers or coolers 15, 20 to separate and collect the condensed liquid before it is compressed in the pump 25, to be then reinjected in the compression unit/group stages 221, 222.

Embodiments herein also relate to a system for recovering waste heat by a combination of a Brayton cycle combined with a Rankine cycle using reciprocating machine wherein the reciprocating compression unit/group 22 and the reciprocating expansion unit/group 18 of the Brayton cycle system are arranged according to a tandem configuration.

In an exemplary embodiment of the system, according to a tandem configuration, the reciprocating compression unit/group 22 and the reciprocating expansion unit/group 18 of the Brayton cycle system both comprise one or more respective cylinders, the cylinders of the reciprocating compression unit/group 22 and the cylinders of the reciprocating expansion unit/group 18 being connected by a common rod, which in turn is coupled to the common shaft connected to the generator 26 or any other appliances, in such a way that the forces equilibrium is closed on the common rod itself; this allowing to have reduced gas loads on the shaft, that can consequently be smaller and lighter, as well as to reduce the size of the crankcase, leading to less friction losses and to manufacturing and installation cost saving.

Furthermore, according to this embodiment, leakages from cylinders are limited by differential pressure from the chambers, and, other than contained by labyrinth seals, can be recovered since they fall directly in the connected cylinder, allowing a completely sealed arrangement, to prevent any leakage to the outside.

The invention claimed is:

1. A waste heat recovery system, comprising:

a Brayton cycle system and a Rankine cycle system, the Brayton cycle system comprising, a heater configured to circulate an inert gas in heat exchange relationship with a heating fluid to heat the inert gas;

a first expansion unit coupled to the heater and configured to expand the inert gas;

a first regenerator configured to cool the inert gas from the first expansion unit by evaporating a working fluid of the Rankine cycle system;

a first, liquid-cooled inter-stage heat exchanger configured to further cool the inert gas from the first regenerator; and a compression unit configured to compress the inert gas fed through the first inter-stage heat exchanger, the compression unit comprising a pair of serially-arranged compression unit stages;

a second liquid cooled, inter-stage heat exchanger arranged between the sequentially-arranged compression unit stages;

separator drums placed downstream the inter-stage heat exchangers and adapted to separate and collect condensed cooling liquid; and a first pump adapted to compress the condensed cooling liquid from the separator drums and inject the compressed liquid in the compression unit stages, wherein the second liquid cooled, inter-stage heat exchanger is configured to remove heat from compressed inert gas circulating from consecutive compression unit stages, and wherein the first expansion unit and the compression unit are mechanically-coupled reciprocating machines; and the Rankine cycle system comprising, a second expansion unit coupled to the first regenerator and configured to expand working fluid vapor;

a second regenerator;

a condenser coupled to the second regenerator; and a second pump configured to compress the working fluid fed through the condenser, wherein the second expansion unit is a reciprocating machine mechanically coupled with the first expansion unit and the compression unit of the Brayton cycle system, and wherein the first expansion unit and the compression unit of the Brayton cycle system and the second expansion unit of the Rankine cycle system are connected to a common shaft.

2. The system according to claim 1, wherein the common shaft is directly coupled with an external appliance.

3. The system according to claim 1, wherein the common shaft is directly coupled with a generator.

4. The system according to claim 1, wherein the common shaft is directly coupled with a variable frequency drive generator.

5. The system according to claim 4, wherein the variable frequency drive generator is used as a starting engine of the system or helper in a mechanical drive configuration.

6. The system according to claim 1, wherein the common shaft rotates at about 1000 rotations/min.

7. The system according to claim 1, wherein the cooling liquid is water or a water-based mixture.

8. The system according to claim 1, wherein a heat exchanger is provided to circulate the inert gas from the first expansion unit to the first regenerator in heat exchange relationship with the inert gas from the compression unit to the heater.

9. The system according to claim 1, wherein the second regenerator is provided to circulate the working fluid vapor from the second expansion unit to the condenser in heat exchange relationship with the fluid from the pump to the heat exchanger.

10. The system according to claim 1, wherein the inert gas used as working fluid in the Brayton cycle system is carbon dioxide.

11. The system according to claim 1, wherein the fluid used as the working fluid in the Rankine cycle system is selected from an organic fluid, a refrigerant fluid, water, ammonia, or propane.

12. The system according to claim 11, wherein the organic fluid used as the working fluid in the Rankine cycle system is selected from 1,1,1,3,3-Pentafluoropropane (R245FA) and 2,3,3,3-tetrafluoropropene (or R1234yf).

13. The system according to claim 1, wherein the heater is configured to be coupled with waste heat sources including combustion engines, gas turbines, geothermal, solar thermal, or industrial and residential heat sources.

14. The system according to claim 1, wherein the heater is a burner fed with a fuel to realize a gas engine.

15. The system according to claim 1, wherein the pump configured to compress the fluid of the Rankine cycle system is mechanically coupled with the first expansion unit and the compression unit of the Brayton cycle system and the second expansion unit of the Rankine cycle system.

* * * * *